US009156079B2

(12) United States Patent
Shulkin et al.

(10) Patent No.: US 9,156,079 B2
(45) Date of Patent: Oct. 13, 2015

(54) BLANKS FOR SUPERPLASTIC FORMING

(75) Inventors: Boris Shulkin, West Bloomfield, MI (US); William A. Kokosza, Windsor (CA); Maximillian Amtmann, Brampton (CA)

(73) Assignee: MAGNA INTERNATIONAL INC., Aurora (CA)

( * ) Notice: Subject to any disclaimer, the term of this patent is extended or adjusted under 35 U.S.C. 154(b) by 116 days.

(21) Appl. No.: 13/993,219

(22) PCT Filed: Dec. 16, 2011

(86) PCT No.: PCT/CA2011/001375

§ 371 (c)(1),
(2), (4) Date: Jun. 11, 2013

(87) PCT Pub. No.: WO2012/079157

PCT Pub. Date: Jun. 21, 2012

(65) Prior Publication Data

US 2013/0266730 A1 Oct. 10, 2013

Related U.S. Application Data

(60) Provisional application No. 61/424,313, filed on Dec. 17, 2010.

(51) Int. Cl.
*B05C 21/00* (2006.01)
*B21J 1/02* (2006.01)
(Continued)

(52) U.S. Cl.
CPC ..... *B21J 1/02* (2013.01); *B05C 21/005* (2013.01); *B21D 26/021* (2013.01); *B21D 37/18* (2013.01)

(58) Field of Classification Search
CPC ..... B05C 5/0212; B05C 5/00; B05C 21/005; B05C 17/06; B05B 15/045; C23C 14/042; B21D 26/021; B21D 37/18; B21J 1/02
USPC ..... 118/301, 505, 721
See application file for complete search history.

(56) References Cited

U.S. PATENT DOCUMENTS 2,368,829 A * 2/1945 Harrington ..... 427/425
4,239,016 A * 12/1980 Cathers et al. ..... 118/624
(Continued)

FOREIGN PATENT DOCUMENTS

GB 815804 * 7/1955
JP 8067992 A 3/1996
(Continued)

OTHER PUBLICATIONS

International Search Report dated Mar. 13, 2012 in corresponding International Application No. PCT/CA2011/001375.

*Primary Examiner* — Laura Edwards
(74) *Attorney, Agent, or Firm* — The Law Office of Michael E. Kondoudis

(57) ABSTRACT

The invention is directed to a system and method of applying a coating of lubricant material to the surface of a sheet metal blank in a controlled manner such that some areas of the blank have uniform thickness of lubricant while other areas have no lubricant at all or have a variable amount (progressively increasing or decreasing) of lubricant. This is achieved through the use of a mask template that comprises an over-spray fence and at least one contact element. The lubricated coated sheet metal blank is utile for superplastic forming to produce specialized complex shaped parts. The invention advantageously lessens the possibility of skid or slip lines appearing in the finished product as well as lessens the likely build-up of lubricant in forming dies—easing maintenance requirements.

14 Claims, 7 Drawing Sheets

(51) Int. Cl.
*B21D 26/021* (2011.01)
*B21D 37/18* (2006.01)

(56) References Cited

U.S. PATENT DOCUMENTS

| | | | | |
|---|---|---|---|---|
| 4,406,246 | A * | 9/1983 | DeMeyer et al. | 118/505 |
| 6,106,644 | A | 8/2000 | McCool et al. | |
| 6,769,280 | B2 | 8/2004 | Cao et al. | |
| 6,843,089 | B2 | 1/2005 | Krajewski et al. | |
| 7,284,402 | B2 | 10/2007 | Friedman et al. | |
| 7,575,811 | B2 | 8/2009 | Uchida et al. | |
| 7,653,978 | B2 | 2/2010 | Arnold et al. | |
| 7,730,753 | B2 | 6/2010 | Krajewski et al. | |
| 2003/0232139 | A1 * | 12/2003 | DeTura | 427/282 |
| 2004/0007044 | A1 | 1/2004 | Merle et al. | |
| 2004/0079129 | A1 | 4/2004 | Krajewski et al. | |
| 2009/0205394 | A1 | 8/2009 | Luckey, Jr. et al. | |
| 2010/0269558 | A1 | 10/2010 | Morales | |

FOREIGN PATENT DOCUMENTS

| | | | |
|---|---|---|---|
| JP | 2010149137 | A | 7/2010 |
| WO | 9962653 | A1 | 12/1999 |
| WO | 2007134178 | A1 | 11/2007 |

* cited by examiner

BLANKS FOR SUPERPLASTIC FORMING

FIELD OF THE INVENTION

The instant invention relates generally to blanks for superplastic forming, and more particularly to a system and method for applying a coating of a lubricant material, such as for instance boron nitride, to a surface of a sheet metal blank.

BACKGROUND OF THE INVENTION

Superplastic metallic alloys, such as for instance certain fine grain alloys of aluminum, magnesium, stainless steel and titanium, are relatively ductile and can undergo substantial tensile deformation in the presence of low shaping forces. Such materials are capable of being stretched and formed at suitable forming temperatures over a forming tool or into a die cavity to make complex shaped parts, e.g., automotive body parts, or the like. This process is often referred to as superplastic forming.

In superplastic forming, a sheet metal blank is positioned with one side lying close to the hot forming surface of a heated forming tool in a press. The metal sheet is often preheated to its forming temperature, and gripped at peripheral edges between complementary opposing dies. A pressurized fluid, such as air, is applied to the other side of the metal sheet, thereby forcing and stretching the metal sheet into conformance with the forming surface of one die while maintaining a target strain rate for deforming the sheet throughout the forming cycle. The opposing die provides an air chamber on the pressurized side of the metal sheet. The superplasticity of the material enables forming of complex components that normally cannot be formed by conventional room temperature metal forming processes. For instance, use of the superplastic forming process enables forming a workpiece with a deep cavity or with a cavity formed over very small radii. Further, superplastic forming often permits the manufacture of large single parts that cannot be made by other processes such as sheet metal stamping. A single part formed using superplastic forming can sometimes replace an assembly of several parts made from non-superplastic forming materials and processes.

In production operations, heated sheet metal workpieces are repeatedly placed on the press, formed on the heated tool, and removed. Sliding contact between the deforming metal workpiece and the forming tool often leads to problems associated with friction and adhesion. Typically, lubricants are used in this process to ease material flow over the forming surfaces of the forming tool. The lubricants also act as a release aid to prevent parts from sticking to the tool surfaces. Known lubricant technology includes a boron nitride, water-based slurry with a binder system to promote adhesion of the boron nitride to the metal sheet, and graphite slurries. Of course, both the boron nitride slurry and the graphite slurry have several drawbacks. First, the solid lubricant, e.g. boron nitride, tends to build up quickly in the die, resulting in maintenance down time for cleaning. If not removed regularly, this buildup can collect and harden in the die resulting in a defect on a freshly formed part. Further, the use of solid lubricants can lead to defects in the finished part, such as for instance skid lines or slip lines, as a result of the metal sheet slipping over sharp features on the forming tool.

It would be beneficial to provide a system and method for applying a coating of a lubricant material to a surface of a sheet metal blank, which overcome at least some of the above-mentioned limitations of the prior art.

SUMMARY OF THE INVENTION

According to one aspect, the invention is directed to a system for applying a coating of a lubricant material to a surface of a sheet metal blank, the system comprising: a mount for supporting the sheet metal blank such that the surface of the sheet metal blank is oriented for receiving the coating of the lubricant material; a mask template for protecting a predetermined region of the surface of the sheet metal blank from receiving the coating of the lubricant material, the mask template dimensioned larger than the predetermined region and having a surface that faces toward the surface of the sheet metal blank during the application of the coating of the lubricant material, the mask template comprising: an overspray fence extending to a first distance away from the surface of the mask template, the overspray fence enclosing an area that is the shape and size of the predetermined region; and at least one contact element extending to a second distance that is greater than the first distance away from the surface of the mask template, the at least one contact element for engaging the surface of the sheet metal blank and for releasably securing the mask template to the surface of the sheet metal blank during the application of the coating of the lubricant material; and a sprayer assembly for spraying the lubricant material toward the surface of the sheet metal blank, wherein the overspray fence is spaced-away from the surface of the sheet metal blank when the at least one contact element releasably secures the mask template to the surface of the sheet metal blank.

According to another aspect, the invention is directed to a mask template for protecting a predetermined region of a surface of a sheet metal blank from receiving a coating of a lubricant material, the mask template comprising: a mask element dimensioned larger than the predetermined region and having a first surface on a first side thereof, a second surface on a second side thereof that is opposite the first side, and an edge joining the first surface and the second surface and defining a perimeter around the mask element; an overspray fence extending to a first distance away from the first surface of the mask element, the overspray fence enclosing an area that is the shape and size of the predetermined region; and at least one contact element extending to a second distance that is greater than the first distance away from the first surface of the mask element, the at least one contact element for engaging the surface of the sheet metal blank and for releasably securing the mask template to the surface of the sheet metal blank, wherein the overspray fence is spaced-away from the surface of the sheet metal blank when the at least one contact element releasably secures the mask template to the surface of the sheet metal blank.

According to another aspect, the invention is directed to a method of applying a coating of a lubricant material selectively to a surface of a sheet metal blank, comprising: providing the sheet metal blank with the surface thereof disposed in an orientation for receiving the coating of the lubricant material, wherein a predetermined region of the surface is to be protected from receiving the coating; providing a mask template comprising: a mask element that is dimensioned larger than the predetermined region; an overspray fence that encloses an area having the shape and size of the predetermined region, and a contact element for releasably securing the mask template to the sheet metal blank, wherein the overspray fence and the contact element extend from a surface along one side of the mask element, and wherein the contact element extends from the mask element further than the overspray fence; releasably securing the mask template to the surface of the sheet metal blank via the contact element; directing a spray of the lubricant material toward the mask template and the surface of the sheet metal blank; and releasing the mask template from the surface of the sheet metal blank, wherein a coating of the lubricant material having substantially a uniform thickness is formed on an exposed region of the surface around the mask template, and a coating of the lubricant material having a progressively decreasing thickness is formed adjacent to the exposed region and extending into the predetermined region of the surface.

According to another aspect, the invention is directed to a method of making a shaped product by superplastic forming of a selectively coated sheet metal blank, comprising: providing a tool including a die having features for forming a final shape of the shaped product; providing a selectively coated sheet metal blank that comprises a first surface region having a coating of a lubricant material of substantially uniform thickness, a second surface region that is one of substantially devoid of a coating of the lubricant material and coated with a coating of the lubricant material having a thickness that decreases progressively to a minimum thickness less than the substantially uniform thickness, and a third surface region disposed between the first and second surface regions and having a coating of the lubricant material of a thickness that decreases progressively in a direction from the first surface region to the second surface region; loading the selectively coated sheet metal blank into the tool; and forming the selectively coated sheet metal blank by superplastic forming, such that the second surface region provides an area of slip line reduction.

According to another aspect, the invention is directed to a sheet metal blank for superplastic forming, comprising: a sheet of metal alloy having a composition and a thickness suitable for undergoing superplastic forming, and having a surface on one side thereof comprising: a first surface region having a coating of a lubricant material of a substantially uniform thickness; a second surface region that is one of substantially devoid of a coating of the lubricant material and coated with a coating of the lubricant material having a thickness that decreases progressively to a minimum thickness less than the substantially uniform thickness; and, a third surface region disposed between the first surface region and the second surface region, the third surface region having a coating of the lubricant material of a thickness that decreases progressively in a direction from the first surface region to the second surface region, wherein the second surface region is a region of the sheet metal blank that contacts a sharp character line of a forming die during superplastic forming.

According to another aspect, the invention is directed to a method of applying a coating of a lubricant material selectively to a surface of a sheet metal blank, comprising: determining a first surface region of the sheet metal blank that is to other than receive a coating of the lubricant material having a substantially uniform first thickness; applying, to a second surface region that other than overlaps with the first surface region, a coating of the lubricant material having the substantially uniform first thickness; and applying, to a third surface region that is adjacent to the second surface region, a coating of the lubricant material that decreases progressively in a direction from the second surface region toward the first surface region, wherein the first surface region is a region of the sheet metal blank that contacts a sharp character line of a forming die during superplastic forming.

BRIEF DESCRIPTION OF THE DRAWINGS

The instant invention will now be described by way of example only, with reference to the attached drawings, wherein similar reference numerals denote similar elements throughout the several views, and in which.

DETAILED DESCRIPTION OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
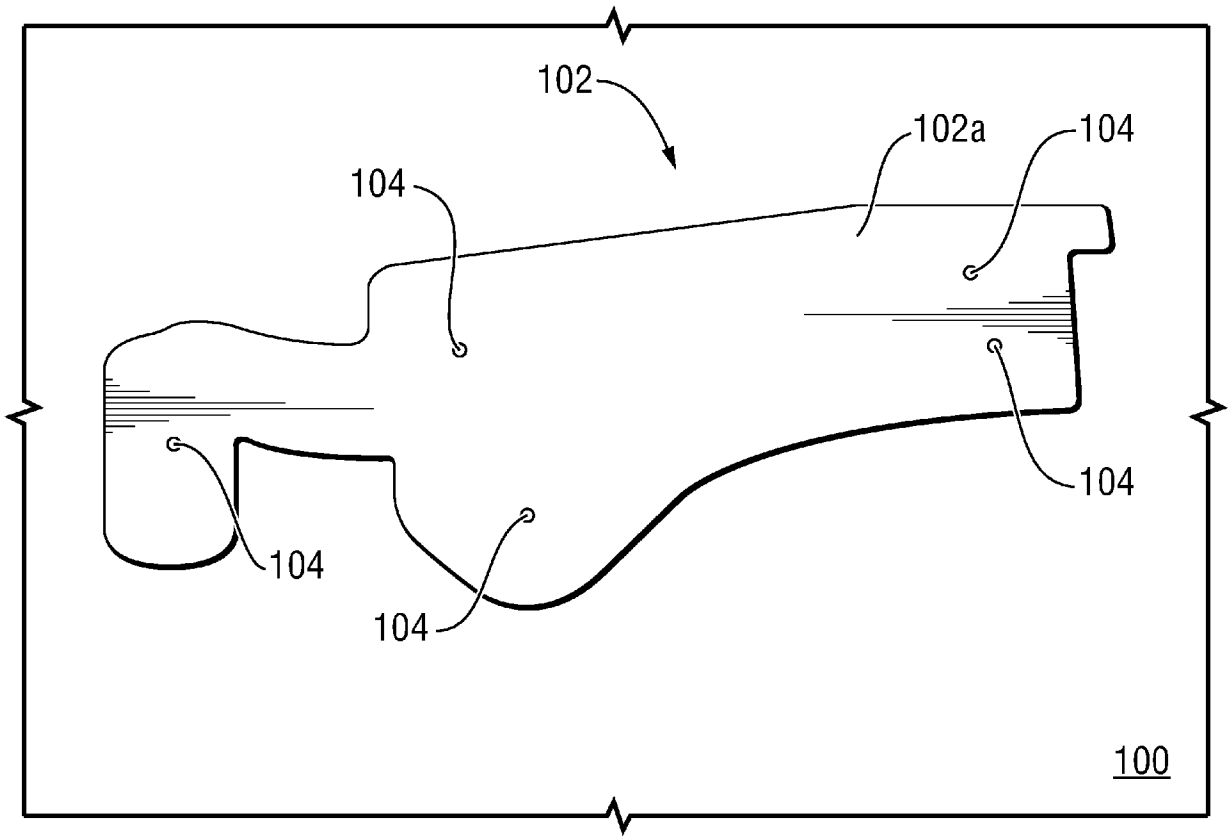
FIG. 1 is a top plan view showing a mask template according to an embodiment of the instant invention.
Figure 2:
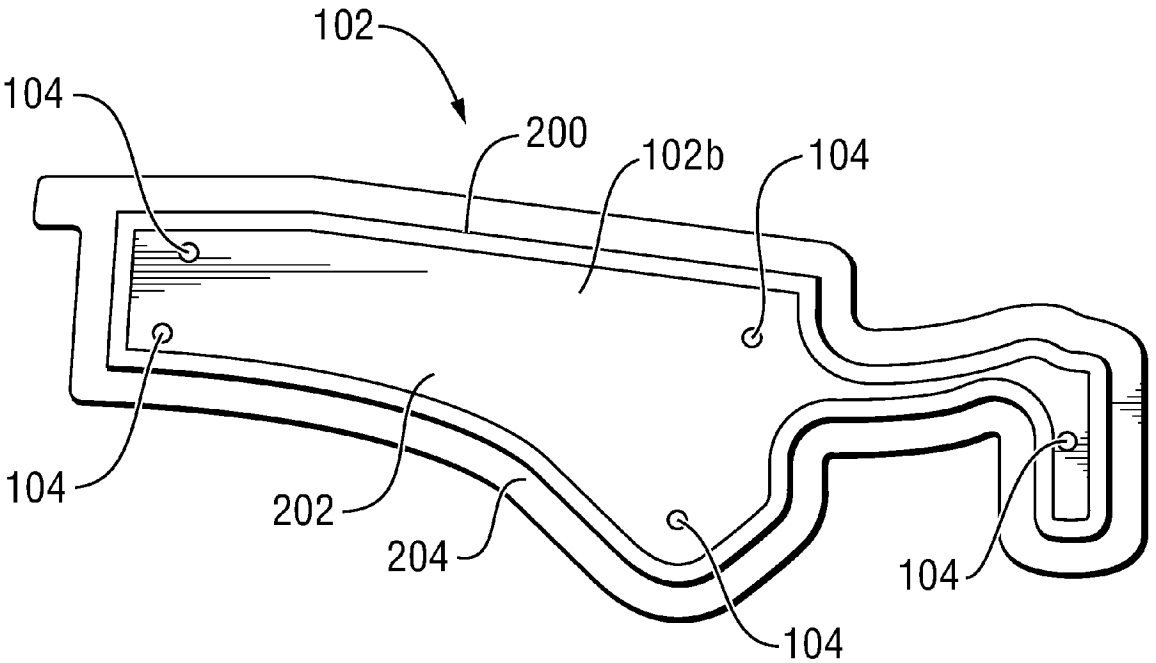
FIG. 2 is a bottom plan view of the mask template shown in FIG. 1.

Reference is made to FIG. 1, in which a sheet metal blank 100 is shown adjacent to a mask template 102. Reference is also made to FIG. 2, which shows a bottom plan view of the mask template 102. More particularly, sheet metal blank 100 is a flat, ductile metal alloy sheet that is suitable for being formed by superplastic forming. For instance, sheet metal blank 100 is fabricated from Aluminum Alloy 5083 and has a thickness of between about 1 mm and about 3 mm. Optionally, another suitable alloy of aluminum, magnesium, titanium or stainless steel is used instead. Initially, the sheet metal blank 100 does not have a coating of a lubricant material, such as for instance boron nitride or another suitable lubricant material.

Mask template 102 comprises a mask element having a first surface 102*a*, which faces toward a sprayer assembly (not shown) during the application of a lubricant coating to the sheet metal blank 100. Also shown in FIG. 1 are mounting ends of a plurality of contact elements 104, extending through the mask element, and which are described in greater detail in the following paragraphs. The function of mask template 102 is to protect a predetermined region of the surface of the sheet metal blank 100 from receiving the coating of the lubricant material. To this end, the mask template 102 has generally the same shape as the predetermined region that is to be protected, but it is dimensioned larger than the predetermined region that is to be protected. In other words, the edge of the mask template 102 extends beyond the predetermined region, such that a second surface 102*b* of the mask template 102 faces a portion of the sheet metal blank that includes the predetermined region as well as a marginal region extending around the predetermined region. The remainder of the surface of the sheet metal blank 100 is considered to be an exposed region. That is to say, when the sprayer assembly sprays lubricant material along a direction that is normal to a surface point within the exposed region, there is nothing to prevent the lubricant material from travelling along a straight-line path to the surface point.

Referring now only to FIG. 2, an overspray fence 200 is provided along the second surface 102*b* of the mask template 102. The overspray fence 200 encloses an area 202 that is the same shape and size as the predetermined region of the surface of the sheet metal blank 100 that is to be protected. A portion 204 of the mask template 102 "overhangs" the overspray fence. Also shown more clearly in FIG. 2 are the contact elements 104. In one embodiment, the contact elements are suction grippers. Of course, depending on the material that is used to fabricate the sheet metal blank 100, other types of contact elements may be used, such as for instance magnetic contact elements. Each of the contact elements 104 extends away from a portion of the second surface 102*b* that is enclosed by the overspray fence 200. In the instant example there are four contact elements 104 shown. Depending on the shape and size of mask element 102, either more than or fewer than five contact elements 104 may be employed. In general, at least one contact element 104 is required in order to ensure that the mask template 102 is releasably secured to the sheet metal blank 100.

Figure 3:
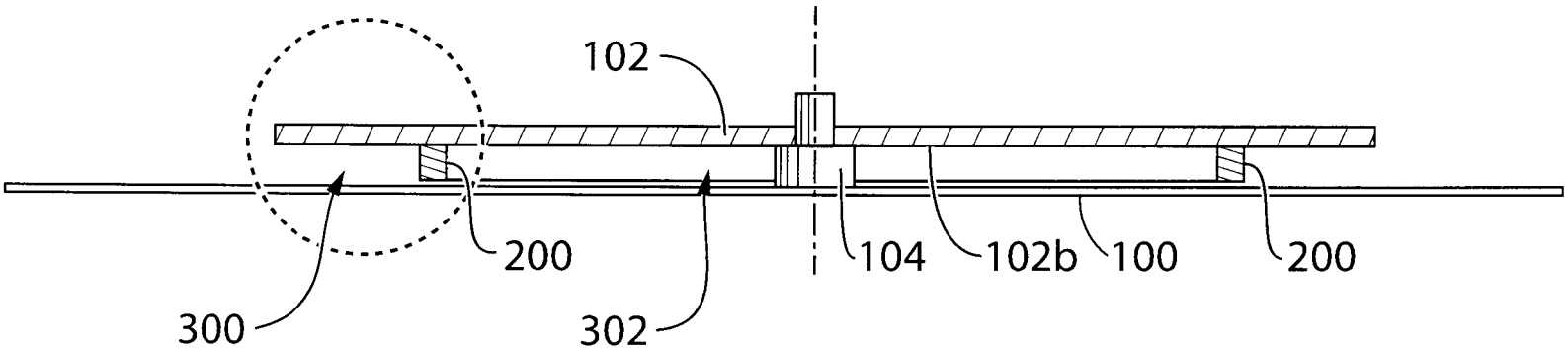
FIG. 3 is a side elevation view of the mask template shown in FIG. 1.

Referring now to FIG. 3, shown is a side elevation view of the mask template 102 with the contact element 104 disposed in engagement with the surface of the sheet metal blank 100. The overspray fence 200 extends to a first distance away from the second surface 102*b* of the mask template 102, and the contact element 104 extends to a second distance greater than the first distance away from the second surface 102*b* of the mask template 102. Accordingly, as is shown in FIG. 3, when the contact element 104 releasably engages the sheet metal blank 100, the overspray fence 200 is spaced away from the surface of the sheet metal blank 100, such that there is a substantially uniform gap between the overspray fence 200 and the sheet metal blank 100. By way of a specific and non-limiting example, the contact element 104 extends to a distance of 15 mm from the second surface 102*b* of the mask template 102 and the overspray fence 200 extends to a distance of 12 mm from the second surface 102*b* of the mask template 102. In this example, there is a 3 mm space between the surface of the sheet metal blank 100 and the overspray fence 200. As is discussed in greater detail in the following paragraphs, the substantially uniform gap between the overspray fence 200 and the surface of the sheet metal blank 100 results in the formation of a coating of the lubricant material having an advantageous thickness profile.

Referring still to FIG. 3 there is a first volume 300, lying outside the perimeter of the overspray fence 200, between the second surface 102*b* of the mask template 102 and the marginal region of the surface of the sheet metal blank 100. Additionally there is a second volume 302, lying inside the perimeter of the overspray fence 200, between the second surface 102*b* of the mask template 102 and the predetermined region of the surface of the sheet metal blank 100. In the instant example, the overspray fence 200 is set back approximately 50 mm from the edge of the mask template 102. The overspray fence 200 is set back from the edge of the mask template 102 by a substantially uniform distance. That being said, optionally the overspray fence 200 does not follow precisely the smaller features of the mask template 102, such as for instance the small extension protruding from the upper left corner of the mask template 102 in FIG. 2.

Figure 4:
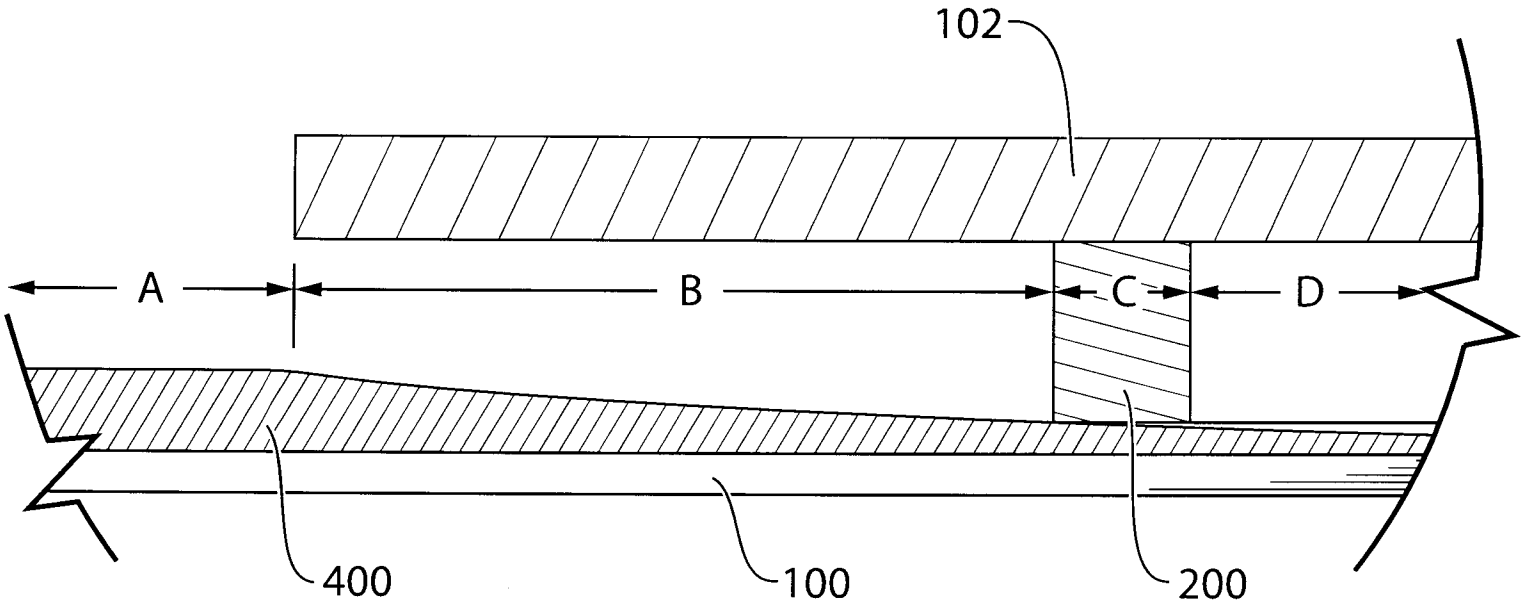
FIG. 4 is a side elevation view showing enlarged detail within the dashed circle of FIG. 3.

FIG. 4 is a side elevation view showing enlarged detail within the dashed circle of FIG. 3. In particular, FIG. 4 shows the surface of the sheet metal blank 100 subsequent to the application of a coating of the lubricant material 400. An area "A" in FIG. 4 is within the exposed region of the surface of the sheet metal blank 100. The coating of lubricant material 400 has a substantially uniform thickness in area "A." Additionally, the coating of lubricant material has a maximum thickness in area "A." An area "B" is within the volume 300 that is shown in FIG. 3, and is characterized by a coating of the lubricant material 400 of progressively decreasing thickness, which is deposited on the marginal region of the sheet metal blank 100 adjacent to the predetermined region. In FIG. 3 the coating on the marginal region is shown to decrease in thickness in a substantially linear fashion, but in practice the decrease in thickness may not be linear. An area "C" corresponds to a region within the gap that is formed between the overspray fence 200 and the surface of the sheet metal blank 100. The gap between the overspray fence 200 and the surface of the sheet metal blank 100 is selected to be a small value, such that only a very small amount of the lubricant material passes through the gap, enters the volume 302, and settles onto the predetermined region of the sheet metal blank 100. Thus, while the predetermined region of the sheet metal blank 100 is considered to be protected from receiving the coating of lubricant material 400 there is, nevertheless, a finite amount of the lubricant material coated onto the predetermined region. More particularly, the distance that the overspray fence 200 is set back from the edge of the mask template 102, and the size of the gap between the overspray fence 200 and the surface of the sheet metal blank 100, are selected such that a "minimum" amount of lubricant material is coated onto the predetermined region to allow effective slip line removal while at the same time ensuring that the predetermined region of the sheet metal blank 100 does not adhere to a surface of the forming tool during superplastic forming. As such, the predetermined region is protected from receiving a coating of the lubricant material that is as thick as the coating within the exposed region. In at least one embodiment, the coating of lubricant material decreases to substantially zero thickness within the predetermined region. In at least one other embodiment, the coating of the lubricant material decreases to a non-zero minimum thickness that is less than the uniform thickness within the exposed region.

Figure 5:
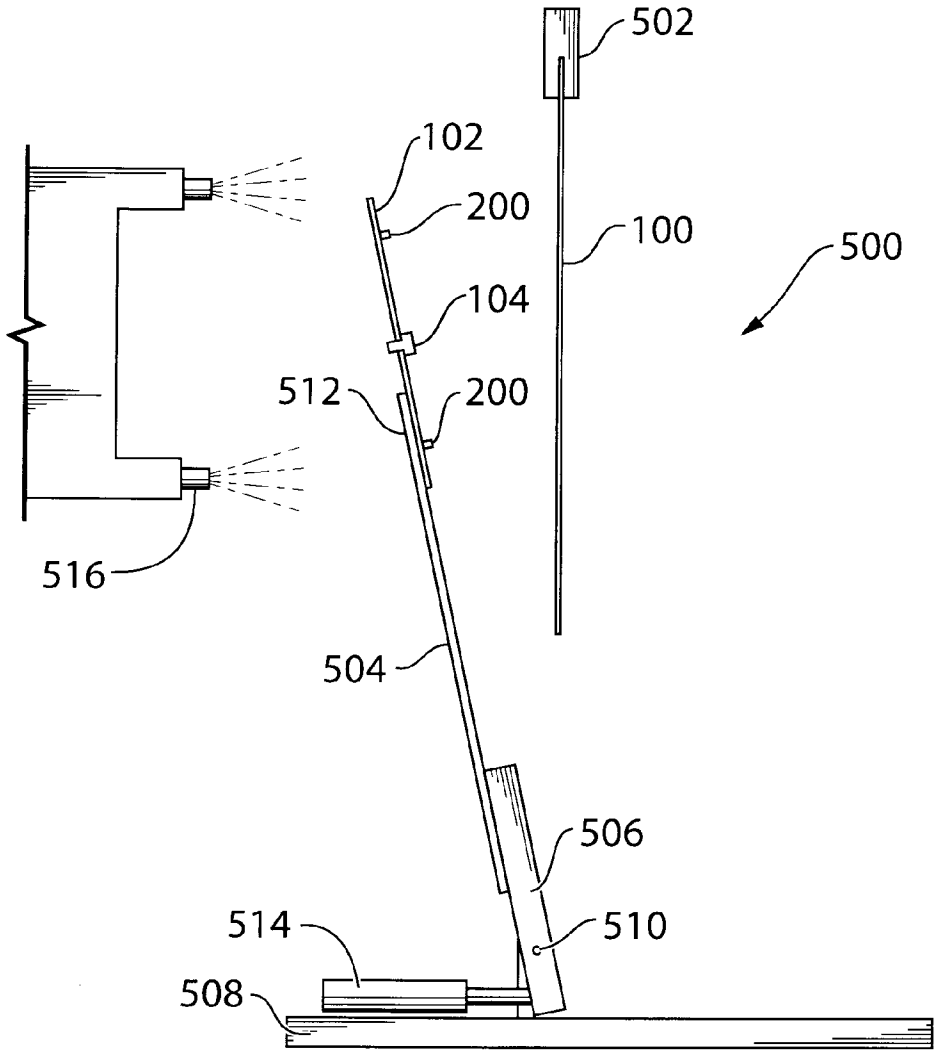
FIG. 5 is a simplified side elevation view showing a system including the mask template of FIG. 1.

Referring now to FIG. 5, shown is a simplified side elevation view of a system 500 for applying a coating of a lubricant material to a sheet metal blank 100, according to an embodiment of the instant invention. A mount 502 grips the sheet metal blank 100 along one edge thereof, such that the sheet metal blank 100 is suspended below the mount 502. The sheet metal blank 100 is gripped such that one surface thereof is oriented for receiving the coating of the lubricant material. A support arm 504 has a first end 506 thereof pivotally mounted to a base element 508 via a pivot pin 510. Mask template 102 is supported at a second end 512 of the support arm 504 opposite the first end. Pivoting of the support arm 504 about the pivot pin 510 moves the mask template 102 between a first position (shown in FIG. 5) in which the contact elements 104 of the mask template 102 are spaced-apart from the surface of the sheet metal blank 100, and a second position (not shown in FIG. 5) in which the contact elements 104 engage the surface of the sheet metal blank 100. For instance, a pneumatic actuator 514 drives the pivot arm 504 between the first and second positions. In an embodiment, the pivot arm 504 is a balanced pivot frame that supports the mask template in two locations.

Referring still to FIG. 5, when the pivot arm 504 is moved into the second position the contact elements 104 of the mask template 102 engage the surface of the sheet metal blank 100, such that the mask template 102 is releasably secured to the surface of the sheet metal blank 100. In addition to securing the mask template 102 to the surface of the sheet metal blank 100, the contact elements 104 also provide a fixed stop such that the overspray fence 200 can be positioned reproducibly adjacent to the predetermined region of the sheet metal blank 100. The sprayer assembly 516 is then actuated to direct a spray of the lubricant material, such as for instance a boron nitride slurry, along a direction toward the surface of the sheet metal blank 100. The sprayer assembly 516 is arranged to provide the spray of the lubricant material in a direction that is substantially normal to the surface of the sheet metal blank 100. As a result, a lubricant material coating of substantially uniform thickness is formed on the surface of the sheet metal blank 100 surrounding the mask template 102, i.e., the exposed region. Some lubricant material travels laterally with respect to the surface of the sheet metal blank 100 and enters into the volume 300 that is shown in FIG. 3, so as to deposit a coating of progressively decreasing thickness on the marginal region of the surface of the sheet metal blank 100 adjacent to the predetermined region. Finally, a quantity of lubricant material overspray "blow-by" enters into the volume 302 that is shown in FIG. 3, via the gap between the overspray fence 200 and the surface of the sheet metal blank 100.

Optionally, the mount 502 is on a paint line comprising a plurality of mounts. The mount 502 is moveable along a direction of the paint line between a first location in which the sheet metal blank 100 is disposed adjacent to the mask template 102 (shown in FIG. 5) and a second location in which the sheet metal blank 100 is other than disposed adjacent to the mask template 102 (not shown).

Optionally the mask template 102 is mounted on a rail guide or another suitable mechanism for moving the mask template 102 into and out of contact with the sheet metal blank. Optionally the sprayer assembly 516 and the mask template 102 are manipulated using one or more programmable robots. Further optionally, the sheet metal blank 100 is gripped along more than one side or it is supported above a mount.

Figure 6:
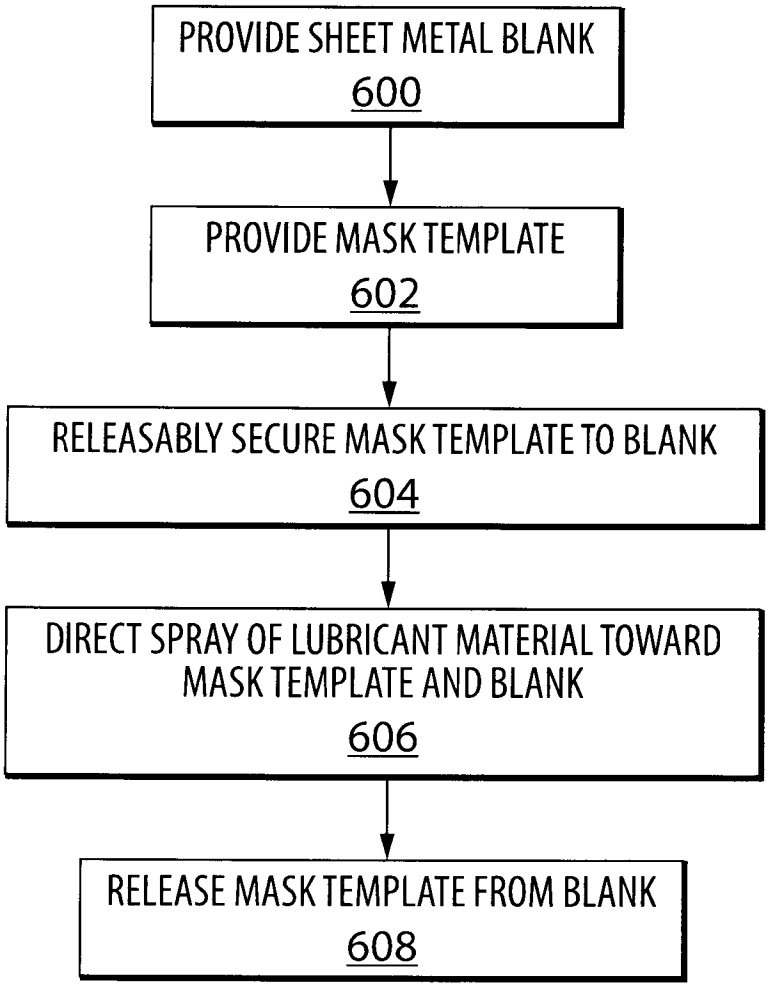
FIG. 6 is a simplified flow diagram for a method of applying a coating of a lubricant material selectively to a surface of a sheet metal blank.

Referring now to FIG. 6, shown is a simplified flow diagram for a method of applying a coating of a lubricant material selectively to a surface of a sheet metal blank. At 600 a sheet metal blank is provided such that the surface thereof is oriented for receiving the coating of the lubricant material. For instance, the sheet metal blank is gripped along one edge by a gripping element, and is suspended below the gripping element. The sheet metal blank has a predetermined region along the surface thereof that is to be protected from receiving a coating of the lubricant material. At 602 a mask template is provided. The mask template is, for example, substantially similar to the mask template 102 described with reference to FIGS. 1 and 2. Said mask template comprises a mask element that is dimensioned larger than the predetermined region of the surface of the sheet metal blank that is to be protected. An overspray fence is disposed along one side of the mask template, the one side for being oriented toward the sheet metal blank during application of the coating of the lubricant material, and the overspray fence enclosing an area having the shape and size of the predetermined area.

Additionally, the mask element includes at least a contact element for releasably securing the mask template to the sheet metal blank. The overspray fence and the contact element extend from the one side of the mask template, and in particular the at least a contact element extends from the mask element further than the overspray fence. Thus, when the mask element is releasably secured to the sheet metal blank via the at least a contact element at 604, there is a gap between the overspray fence and the surface of the sheet metal blank. At 606 a spray of the lubricant material is directed toward the mask template and the surface of the sheet metal blank. At 608 the mask template is released from the surface of the sheet metal blank. The method described with reference to FIG. 6 is suitable for producing a sheet metal blank using the system of FIG. 5, or another similar system.

A selectively coated sheet metal blank, made using the method of FIG. 6, includes a coating of substantially uniform thickness on an exposed region of the surface around the mask template. Additionally, the predetermined region of the surface remains substantially devoid of the lubricant material. As described supra "blow-by" passes through the gap between the overspray fence and the surface of the sheet metal blank, such that a minimum amount of the lubricant material is coated onto the predetermined region of the surface of the sheet metal blank. A coating of progressively decreasing thickness is also formed between the exposed region and the predetermined region of the surface. In an embodiment, the coating of the lubricant material decreases to substantially zero thickness within the predetermined region. In another embodiment, the coating of the lubricant material decreases to a non-zero thickness that is less than the substantially uniform thickness on the exposed region of the surface around the mask template. The coating of progressively decreasing thickness that is formed between the exposed region and the predetermined region of the surface defines a non-stepped transition region.

A sheet metal blank for superplastic forming, according to an embodiment of the instant invention, comprises a coated region having a coating of a lubricant material that is of substantially uniform thickness. The sheet metal blank further comprises a predetermined region that is one of substantially devoid of a coating of the lubricant material and coated with a coating of the lubricant material having a thickness that decreases progressively to a minimum thickness less than the substantially uniform thickness on the coated region. Disposed between the coated region and the predetermined region is a marginal region having a coating of the lubricant material that decreases progressively in thickness in a direction from the coated region toward the predetermined region, thereby defining a non-stepped transition region. In one embodiment, the predetermined region is protected from receiving a coating of the lubricant material during a step of applying the lubricant material coating to the sheet metal blank. As discussed supra, one way of achieving this result is to use a mask template. Alternatively, a sprayer system is employed absent a mask template, in which for instance plural sprayers are used to apply a coating of the lubricant material having the above-described thickness profile. For instance, a first sprayer is controlled to apply a coating of the lubricant material of substantially uniform thickness within the coated region, and a second sprayer is used to apply the coating of the lubricant material that decreases in thickness in a direction from the coated region to the predetermined region. In this case, the second sprayer, which may comprise more than one individual sprayer, is configured to deliver a precisely controlled spray of the lubricant material so as to create the desired thickness profile. Further alternatively, a portion of an existing coating of the lubricant material is removed selectively from a uniformly coated sheet metal blank, in order to form the predetermined region. In addition, the existing coating of the lubricant material is tapered or "feathered" within a marginal region around the predetermined region, such that the coating of the lubricant material decreases progressively in a direction toward the predetermined region.

For clarity, the "predetermined region" of the sheet metal blank, as it has been referred to in the preceding paragraphs, is a region of the sheet metal blank that is intended to contact a sharp character line of a forming die during superplastic forming. The term "sharp character lines" is understood to mean any surface features along a forming surface of a forming die that cause the formation of cosmetically visible skid or slip lines in the class A surface of finished products that are formed within the forming die by superplastic forming. As described in the preceding paragraphs, the predetermined region of a sheet metal blank is one of i) substantially devoid of a coating of a lubricant material and ii) coated with a coating of the lubricant material having a thickness that is less than regions of the sheet metal blank surrounding the predetermined region. Skid or slip line reduction is observed in the class A surface of finished products that are formed from sheet metal blanks when the predetermined region of the sheet metal blank contacts sharp character lines of the forming die during superplastic forming.

Figure 7:
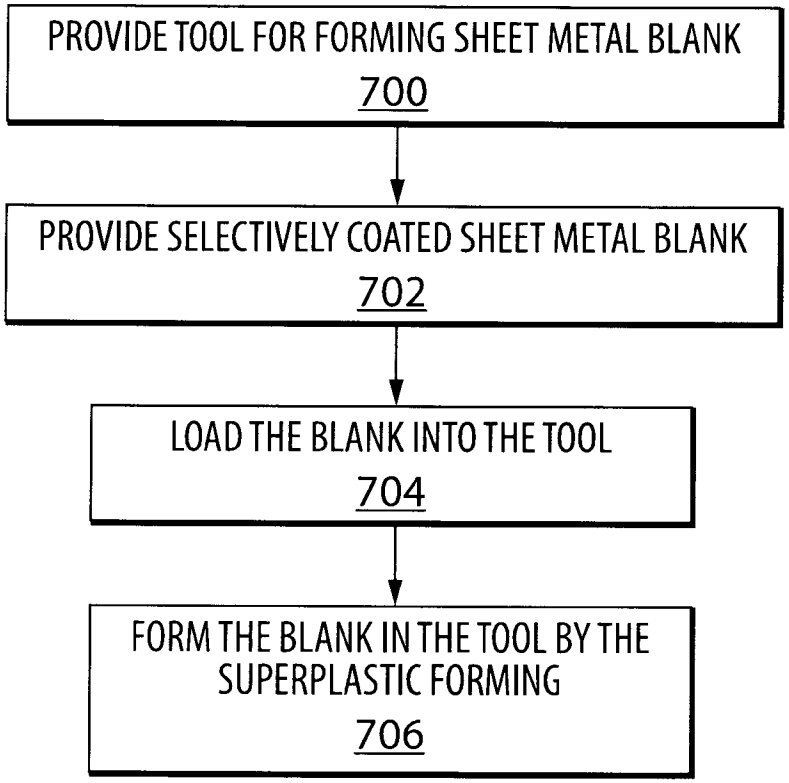
FIG. 7 is a simplified flow diagram for a method of making a shaped product by superplastic forming of a selectively coated sheet metal blank.

Referring now to FIG. 7, shown is a simplified flow diagram for a method of making a shaped product by superplastic forming of a selectively coated sheet metal blank. At 700 a forming tool is provided, including a die having features for forming a final shape of the shaped product. Certain portions of the forming surface are for forming sharp features or character lines of the final shaped product. At 702 a selectively coated sheet metal blank is provided, which comprises a first surface region having a coating of a lubricant material of substantially uniform thickness. The sheet metal blank also comprises a second surface region that is one of substantially devoid of a coating of the lubricant material and coated with a coating of the lubricant material having a thickness that decreases progressively to a minimum thickness less than the substantially uniform thickness. Additionally, the sheet metal blank comprises a third surface region disposed between the first and second surface regions and having a coating of the lubricant material of a thickness that decreases progressively in a direction from the first surface region to the second surface region. Optionally, the blank is fabricated using the method as described with reference to FIG. 6, or it is fabricated by applying the lubricant material selectively but without using a template mask as described above, or it is fabricated by selectively removing a portion of a lubricant coating from a coated sheet metal blank also as described above. At 704 the selectively coated sheet metal blank is loaded into the tool. At 706 the selectively coated sheet metal blank is formed by superplastic forming, such that the second surface region provides an area of slip line reduction. Again for clarity, the second surface region is formed during superplastic forming on a portion of the forming surface that contains sharp character lines. As will be understood by a person having ordinary skill in the art, the term "sharp character lines" means surface features of the forming surface of a forming die that cause the formation of skid and slip lines that are cosmetically visible in the Class A surface of finished products formed by superplastic forming. Skid or slip line reduction is observed in the class A surface of finished products that are formed from sheet metal blanks when the second surface region of the sheet metal blank contacts sharp character lines of the forming die during superplastic forming.

While the above description constitutes a plurality of embodiments of the present invention, it will be appreciated that the present invention is susceptible to further modification and change without departing from the fair meaning of the accompanying claims.

What is claimed is:

1. A system for applying a coating of a lubricant material to a surface of a sheet metal blank, the system comprising:

a mount for supporting the sheet metal blank such that the surface of the sheet metal blank is oriented for receiving the coating of the lubricant material;

a mask template for protecting a predetermined region of the surface of the sheet metal blank from receiving the coating of the lubricant material, the mask template dimensioned larger than the predetermined region and having a surface that faces toward the surface of the sheet metal blank during the application of the coating of the lubricant material, the mask template comprising:

an overspray fence extending to a first distance away from the surface of the mask template, the overspray fence enclosing an area that is the same shape and size as the predetermined region, and the overspray fence being set back from the edge of the mask template such that a portion of the mask template overhangs the overspray fence; and at least one contact element extending to a second distance that is greater than the first distance away from the surface of the mask template, the at least one contact element for engaging the surface of the sheet metal blank and for releasably securing the mask template to the surface of the sheet metal blank during the application of the coating of the lubricant material; and a sprayer assembly for spraying the lubricant material toward the surface of the sheet metal blank, wherein the overspray fence is spaced-away from the surface of the sheet metal blank when the at least one contact element releasably secures the mask template to the surface of the sheet metal blank.

2. The system according to claim 1, wherein the mask template has an edge that defines a perimeter around the mask template, and wherein the overspray fence is set back from the edge by a substantially uniform distance around the perimeter of the mask template.

3. The system according to claim 1, wherein the at least one contact element extends from a portion of the surface of the mask template that is within the area enclosed by the overspray fence.

4. The system according to claim 1, wherein the at least one contact element supports the mask template in a spaced-apart relationship with the sheet metal blank.

5. The system according to claim 1, wherein the at least one contact element comprises a suction gripper.

6. The system according to claim 1, wherein the mask template is movable between a first position in which the at least one contact element is spaced-apart from the surface of the sheet metal blank and a second-position in which the at least one contact element engages the surface of the sheet metal blank.

7. The system according to claim 1, comprising a support arm having a first end pivotally mounted to a base element and having a second end opposite the first end, the second end supporting the mask template, wherein pivoting of the support arm moves the mask template between a first position in which the at least one contact element is spaced-apart from the surface of the sheet metal blank and a second-position in which the at least one contact element engages the surface of the sheet metal blank.

8. The system according to claim 1, wherein the mount comprises a gripper for gripping the sheet metal blank along one edge thereof, and wherein the sheet metal blank is suspended below the mount when the gripper grips the sheet metal blank along the one edge thereof.

9. The system according to claim 1, wherein the sprayer assembly is arranged to provide a spray of the lubricant material in a direction that is substantially normal to the surface of the sheet metal blank.

10. The system according to claim 1, wherein the mount is on a paint line comprising a plurality of mounts, the mount moveable along a direction of the paint line between a first location in which the sheet metal blank is disposed adjacent to the mask template and a second location in which the sheet metal blank is other than disposed adjacent to the mask template.

11. A mask template for protecting a predetermined region of a surface of a sheet metal blank from receiving a coating of a lubricant material, the mask template comprising:

a mask element dimensioned larger than the predetermined region and having a first surface on a first side thereof, a second surface on a second side thereof that is opposite the first side, and an edge joining the first surface and the second surface and defining a perimeter around the mask element;

an overspray fence extending to a first distance away from the first surface of the mask element, the overspray fence enclosing an area that is the same shape and size as the predetermined region and the overspray fence being set back from the edge of the mask element such that a portion of the mask element overhangs the overspray fence; and at least one contact element extending to a second distance that is greater than the first distance away from the first surface of the mask element, the at least one contact element for engaging the surface of the sheet metal blank and for releasably securing the mask template to the surface of the sheet metal blank, wherein the overspray fence is spaced-away from the surface of the sheet metal blank when the at least one contact element releasably secures the mask template to the surface of the sheet metal blank.

12. The mask template according to claim 11, wherein the overspray fence is set back from the edge of the mask element by a substantially uniform distance around the perimeter of the mask element.

13. The mask template according to claim 11, wherein the at least one contact element extends from a portion of the first surface that is within the area enclosed by the overspray fence.

14. The mask template according to claim 11, wherein the at least one contact element comprises a suction gripper.

* * * * *